United States Patent [19]

Wolfe

[11] Patent Number: 4,662,301

[45] Date of Patent: May 5, 1987

[54] FLOATING PLATFORM FOR DECORATIVE ARTICLES

[76] Inventor: Henry S. Wolfe, 14480 62nd St., North, Clearwater, Fla. 33520

[21] Appl. No.: 792,218

[22] Filed: Oct. 28, 1985

[51] Int. Cl.[4] ..... B63B 35/00

[52] U.S. Cl. ..... 114/264; 441/1; 441/29; 441/30

[58] Field of Search ..... 114/125, 345, 264; 441/1, 6, 11, 29, 30, 40

[56] References Cited

U.S. PATENT DOCUMENTS 3,180,639 4/1965 Cotler et al. ..... 441/30

FOREIGN PATENT DOCUMENTS 0006092 1/1975 Japan ..... 441/40

*Primary Examiner*—Sherman D. Basinger
*Attorney, Agent, or Firm*—Ronald E. Smith

[57] ABSTRACT

A floating platform for supporting articles in a swimming pool or other body of water. The platform has a toroidal outer chamber filled with air, a toroidal middle chamber filled with water, and a toroidal inner chamber filled with air. An article supporting member that may take the form of one or more upstanding hollow columns projects upwardly from the inner chamber. The article supporting member in one embodiment is in fluid communication with the inner chamber but in a second embodiment it is not. In either embodiment, a decorative article such as an inflated flamingo, dolphin or other work of art may be in fluid communication with the support member or members. The weight of the water in the middle chamber provides a stable foundation to maintain the supported article in an upright disposition, and the pressure of the air in the inner and outer chambers maintains the water in the middle chamber in an evenly distributed disposition.

11 Claims, 6 Drawing Figures

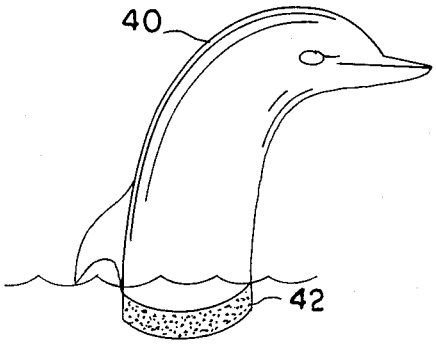
FIG_5
PRIOR ART
FIG_4
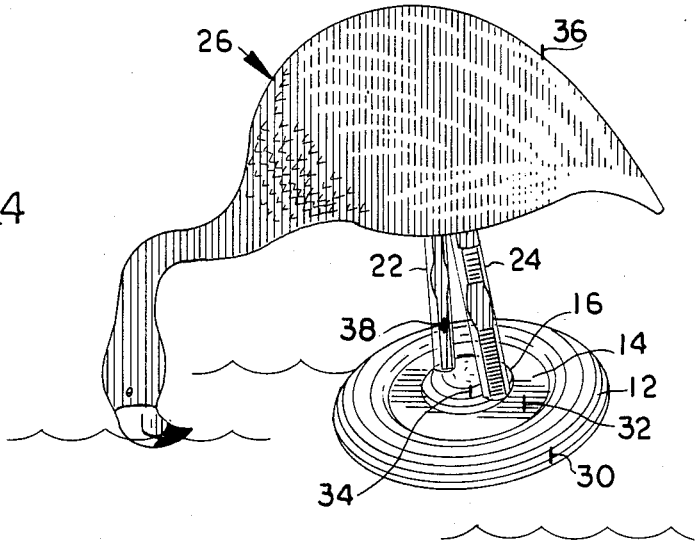
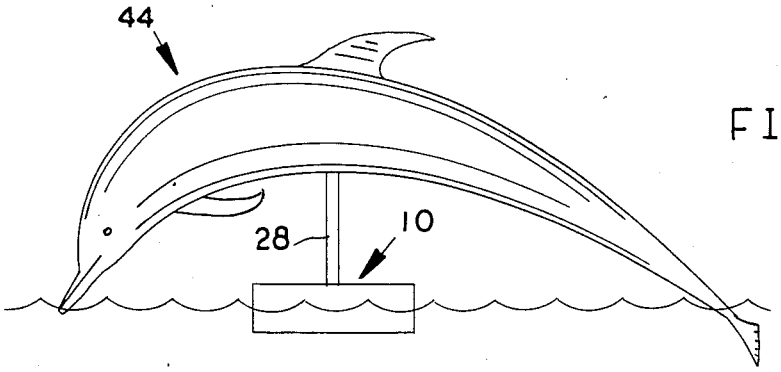
FIG_6

FLOATING PLATFORM FOR DECORATIVE ARTICLES

BACKGROUND OF THE INVENTION

1. Field of the Invention

This invention relates, generally, to platforms for supporting articles, and more particularly relates to a floating platform for supporting an inflated article.

2. Description of the Prior Art

The present inventor filed a patent application entitled "(insert title of application") or (insert filing date). That application, still pending, disclosed a floating platform of generally disc-shaped configuration, i.e., the platform appears circular when seen in plan view; when viewed in side elevation, the platform is seen to have an upper chamber and a lower chamber. The lower chamber is filled with water to anchor the platform, and the upper chamber is filled with air to provide buoyancy. Moreover, the upper chamber is in fluid communication with a hollow upstanding article support means that projects upwardly therefrom, and an inflated decorative article is supported by such support means.

While the platform just described has utility, it has been found that the weight of the water in the lower chamber does not stabilize the platform to the extend desired. Thus, there is a need for a floating platform of increased stability.

The prior art also includes means for displaying decorative articles such as dolphins in pools where the article is maintianed in an upright position by means of weights. However, this type of display immerses the article to be displayed in water and thus hides from view a substantial amount of the display article.

Thus, there is also a need for a device that can display articles above the water line so that the entire article can be seen.

SUMMARY OF THE INVENTION

The present invention has four parts that cooperate with one another to provide a floating platform of increased stability and versatility: an air-filled outer chamber, a water-filled middle chamber, an air-filled inner chamber and an air filled article supporting means in the form of one or more hollow columns that project upwardly from the inner chamber.

Each of the three chambers is of toroidal configuration. The air in the outer and inner chambers surrounds the water in the middle chamber and compresses it, forcing it to maintain its toroidal shape.

The article supporting means may or may not be in fluid communication with the inner chamber, depending upon the embodiment constructed. Where it is desired to isolate the article supporting means from the inner chamber, a wall impermeable to gaseous fluids separates the two and each member is provided with its own gaseous fluid inlet means. Where no wall separates the two, a common inlet means is provided.

It is the primary object of this invention to provide a stable floating platform for decorative works of art of the type that would enhance the appearance of a swimming pool.

A more fundamental object is to provide floating platforms for the support of sundry other items, whether decorative or not, in environments other than swimming pools.

The invention accordingly comprises the features of construction, combinatión of elements and arrangements of parts that will be exemplified in the construction hereinafter set forth, and the scope of the invention will be indicated in the claims.

BRIEF DESCRIPTION OF THE DRAWNGS

For a fuller understanding of the nature and objects of the invention, reference should be made to the following detailed description, taken in connection with the accompanyng drawings, in which:

FIG. 4 is a perspective view of the float showing a decorative article supported thereby;

FIG. 5 is a side elevational view of a prior art device; and

FIG. 6 is a side elevational view of an embodiment of the invention where only one article support member is employed.

DETAILED DESCRIPTION OF THE PREFERRED EMBODIMENT

Figure 1:
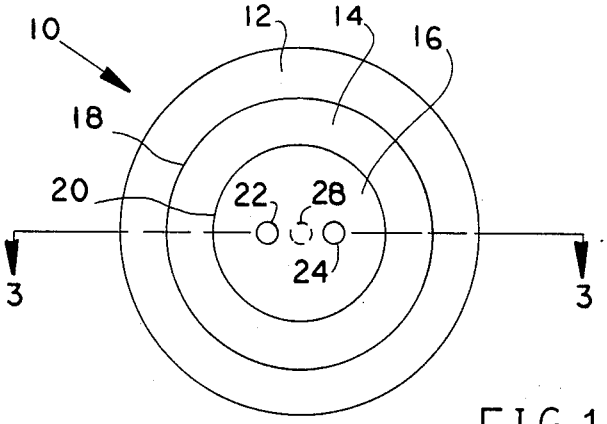
FIG. 1 is a plan view of an embodiment of the invention where the article supported by the platform is not shown.

Referring now to FIG. 1, it will there be seen that the inventive structure is designated by the reference numeral 10 as a whole.

The platform 10 includes a toroidal outer chamber 12, a concentric toroidal middle chamber 14, and a concentric disc-shaped inner chamber 16.

Annular wall 18 divides outer chamber 12 from middle chamber 14, and annular wall 20 divides middle chamber 14 from inner chamber 16.

Figure 2:
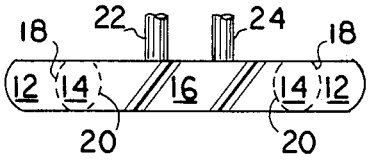
FIG. 2 is a side elevational view of the embodiment of FIG. 1.
Figure 3:
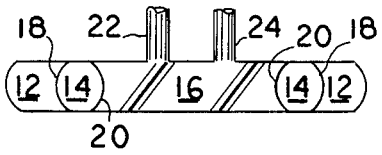
FIG. 3 is a sectional view taken along line 3—3 of FIG. 1.

A pair of laterally spaced, hollow columns 22, 24 are secured to and project upwardly from inner chamber 16, as best shown by FIGS. 2–4. These columns are used to support an inflatable article such as the flamingo 26 shown in FIG. 4.

A single, centered column 28, shown in phantom lnes in FIG. 1, could be employed in lieu of columns 22, 24, however, or more than two columns could be employed as well since any plurality of columns are within the scope of this invention.

Outer chamber 12 is filled with a gaseous fluid such as air at inlet means 30 (FIG. 4); inner chamber 14 is filled with a liquid fluid such as water at inlet means 32 and inner chamber 16 is filled with a gaseous fluid such as air at inlet means 34.

As shown in FIG. 3, article support members 22, 24 are in fluid communication with inner chamber 16 and as shown in FIG. 4, the interior of the decorative article 26 is in fluid communication with supports 22, 24 as well. Thus, air introduced into inlet means 34 will fill inner chamber 16, columns 22, 24 and the inflated decorative article 26.

Where it is desired to isolate the columns 22, 24 from inner chamber 16, a separate inlet means 36 on the figure 26 or a separate inlet means 38 on either support column would be employed.

Referring now to FIGS. 2 and 3, it will there be observed that annular walls 18 and 20 assume a convex shape as depicted when the respective chambers are filled with air and water. Middle chamber 14 is charged with water as aforesaid, which water presses both radially outwardly and radially inwardly to bear against annular walls 18 and 20, respectively.

Air in chambers 12 and 16 maintains the water in chamber 14 in a definite toroidal configuration, however. The air pressure that both surrounds and is surrounded by the water serves to bottle the water in a manner remniscient of the magnetic bottling of plasma in Tokomak-type fusion reactors.

Accordingly, the stability and effectiveness of the platform are considerable. The inner and outer chambers provide the desired buoyancy while the middle chamber provides weight to keep the platform 10 from tipping over in windy conditions.

The platform has been shown as toroidal in configuration, but any other geometrical configuration could be employed as well. Thus, FIG. 1 should be construed as depicting a triangular or other polygonal platform as well.

FIG. 5 depicts how a decorative article in the form of a dolphin is displayed in a pool in accordance with the techniques of the prior art. The dolphin 40 is provided with a weighted end 42 which maintains it in upright position, but the major portion of the dolphin is underwater and hidden from view.

FIG. 6 shows how the complete body of a dolphin or other animal can be displayed above water with the inventive device 10. A dolphin 44 is shown supported by a single article support column 28.

In FIGS. 4 and 6 the article supported by the article support members has at least one portion which extends downwardly to the level of the platform 10 so as to further stabilize the article and platform.

Thus, it is clear that the versatility of the novel platform 10 opens up a new arena for creative design of pool decorations. Moreover, the design of a toroidal chamber of water sandwiched between toroidal chambers of air has applications extending to open water platforms for sundry items as well.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A floating platform for supporting decorative articles, comprising, an outer member of toroidal configuration, said outer member filled with a gaseous fluid, a middle member of toroidal configuration disposed in co-planar, surrounded relation to said outer member, said middle member filled with a liquid fluid, an inner member of disc-shaped configuration disposed in co-planar, surrounded relation to said middle member, said inner member filled with a gaseous fluid, an article supporting means extending upwardly from said inner member, an article supported by said article supporting means, said article having at least one portion thereof extending downwardly to the level of said outer, middle and inner members so that said floating platform is further stabilized.

2. The floating platform of claim 1, wherein said article supporting means is filled with a gaseous fluid.

3. The floating platform of claim 2, wherein said inner chamber and said article supporting means are in fluid communication with one another so that a gaseous fluid supplied to said inner chamber through a gaseous fluid inlet means also enters into and fills said article supporting means.

4. The floating platform of claim 3, wherein said article supporting means includes a single upstanding hollow column member.

5. The floating platform of claim 3, wherein said article supporting means includes a plurality of upstanding hollow column members.

6. The floating platform of claim 2, wherein said inner chamber and said article supporting means are not in fluid communication with one another and wherein said inner chamber and article supporting means are provided with gaseous fluid inlet means individual thereto.

7. The floating platform of claim 6, wherein said article supporting means includes a single upstanding hollow column member.

8. The floating platform of claim 4, wherein said article supporting means includes a plurality of upstanding hollow support members.

9. The floating platform of claim 1, wherein the predetermined geometrical configuration of said outer, middle and lower chambers is toroidal.

10. The floating platform of claim 1, wherein the gaseous fluid in said outer and inner chambers is air.

11. The floating platform of claim 1, wherein the liquid fluid in said middle chamber is water.

* * * * *